US011670878B2

(12) United States Patent
Wu

(10) Patent No.: US 11,670,878 B2
(45) Date of Patent: Jun. 6, 2023

(54) TERMINAL BLOCK STRUCTURE

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 80 days.

(21) Appl. No.: 17/324,048

(22) Filed: May 18, 2021

(65) Prior Publication Data

US 2022/0376409 A1 Nov. 24, 2022

(51) Int. Cl.
*H01R 4/48* (2006.01)
*H01R 9/24* (2006.01)

(52) U.S. Cl.
CPC ..... *H01R 9/24* (2013.01); *H01R 4/4827* (2013.01)

(58) Field of Classification Search
CPC .. H01R 4/4818; H01R 4/4827; H01R 4/4836; H01R 4/4809; H01R 9/223; H01R 9/2608; H01R 9/2675
USPC ..... 174/74 R, 78, 84 R, 88 R; 439/370, 441, 439/76.2, 395
See application file for complete search history.

(56) References Cited

U.S. PATENT DOCUMENTS

| | | | | |
|---|---|---|---|---|
| 8,475,191 | B2 * | 7/2013 | Schafmeister | H01R 4/4836 439/489 |
| 8,794,994 | B2 * | 8/2014 | Kollmann | H01R 13/42 439/441 |
| 9,413,085 | B2 * | 8/2016 | Hoppmann | H01R 4/4836 |
| 9,466,894 | B2 * | 10/2016 | Wu | H01R 4/4836 |
| 10,164,349 | B2 * | 12/2018 | Koellmann | H01R 9/2675 |
| 10,193,245 | B2 * | 1/2019 | Lorenschat | H01R 4/4836 |
| 11,095,053 | B1 * | 8/2021 | Wu | H01R 9/2416 |
| 2014/0370740 | A1 * | 12/2014 | Kollmann | H01R 13/627 439/438 |
| 2015/0044897 | A1 * | 2/2015 | Wu | H01R 13/62933 439/352 |
| 2016/0049737 | A1 * | 2/2016 | Aporius | H01R 13/633 439/733.1 |
| 2018/0006385 | A1 * | 1/2018 | Wilinski | H01R 9/223 |

* cited by examiner

*Primary Examiner* — William H. Mayo, III
(74) *Attorney, Agent, or Firm* — Chun-Ming Shih; HDLS IPR Services

(57) ABSTRACT

A terminal block structure includes an insulative base, a conductive terminal, a toggle member and an elastic clamping piece. The insulative base has a chamber, a wire hole and an opened trough communicating with the chamber. The wire hole and the opened trough are located on the same side of the insulative base. The conductive terminal is fixed in the chamber. The toggle member has a main body, a stem and a pressing portion extended from the main body. The main body has a pivoting portion pivotally connected to the insulative base. The stem projects to outside of the insulative base from the opened trough and is movable on a lateral side of the wire hole. The elastic clamping piece is disposed in the chamber. An end of the elastic clamping piece is pressed by the pressing portion to operably open or close the wire hole.

9 Claims, 8 Drawing Sheets

TERMINAL BLOCK STRUCTURE

BACKGROUND

Technical Field

The disclosure relates to a terminal block structure, particularly to a terminal block structure with easy wire insertion.

Related Art

Terminal block structures have been widely applied in machine equipment, industrial control equipment and electrical appliances. A terminal block structure is an electric connection device for electrically connecting wires. A related-art terminal block structure is composed of an insulative base and a conductive terminal. The inside of the insulative base is provided with an elastic sheet for fixing a wire. By a pressing operation to the elastic sheet through a stem member, a wire can be inserted into the insulative base to connect with the conductive terminal. The wire is held in the insulative base by the pressing of the elastic sheet.

In order to save the operation space and increase the wiring utility, the moving range of the stem member is usually limited to be within two sides of the insulative base to prevent the stem member from interfering with other components. However, that affects the opening extent of the elastic sheet due to the limited moving range of the stem member. As a result, a wire is difficult to be inserted. Accordingly, how to enlarge the opening extent of the elastic sheet to make a wire be inserted more easily and save the operation space is an issue to be solved.

SUMMARY

An object of the disclosure is to increase the opening space of the elastic clamping piece to make a wire be inserted more easily.

To accomplish the above object, the disclosure provides a terminal block structure which includes an insulative base, a conductive terminal, a toggle member and an elastic clamping piece. The insulative base has a chamber, a wire hole and an opened trough communicating with the chamber. The wire hole and the opened trough are located on the same side of the insulative base. The conductive terminal is fixed in the chamber and arranged corresponding to the wire hole. The toggle member includes a main body, a stem and a pressing portion. The stem and the pressing portion are spaced apart and extended from the main body. The main body includes a pivoting portion pivotally connected to the insulative base. The pivoting portion is arranged between the stem and the pressing portion. The stem projects to outside of the insulative base from the opened trough and is movable on a lateral side of the wire hole. The elastic clamping piece is disposed in the chamber. An end of the elastic clamping piece is pressed by the pressing portion to operably open or close the wire hole.

The disclosure further has following functions. By the engaging trough and the rod, the elastic clamping piece may be fixed in the chamber. Thus, more terminal block structures may be accommodated in the same volume range to effectively reduce the installation and use costs.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

DETAILED DESCRIPTION

Figure 1:
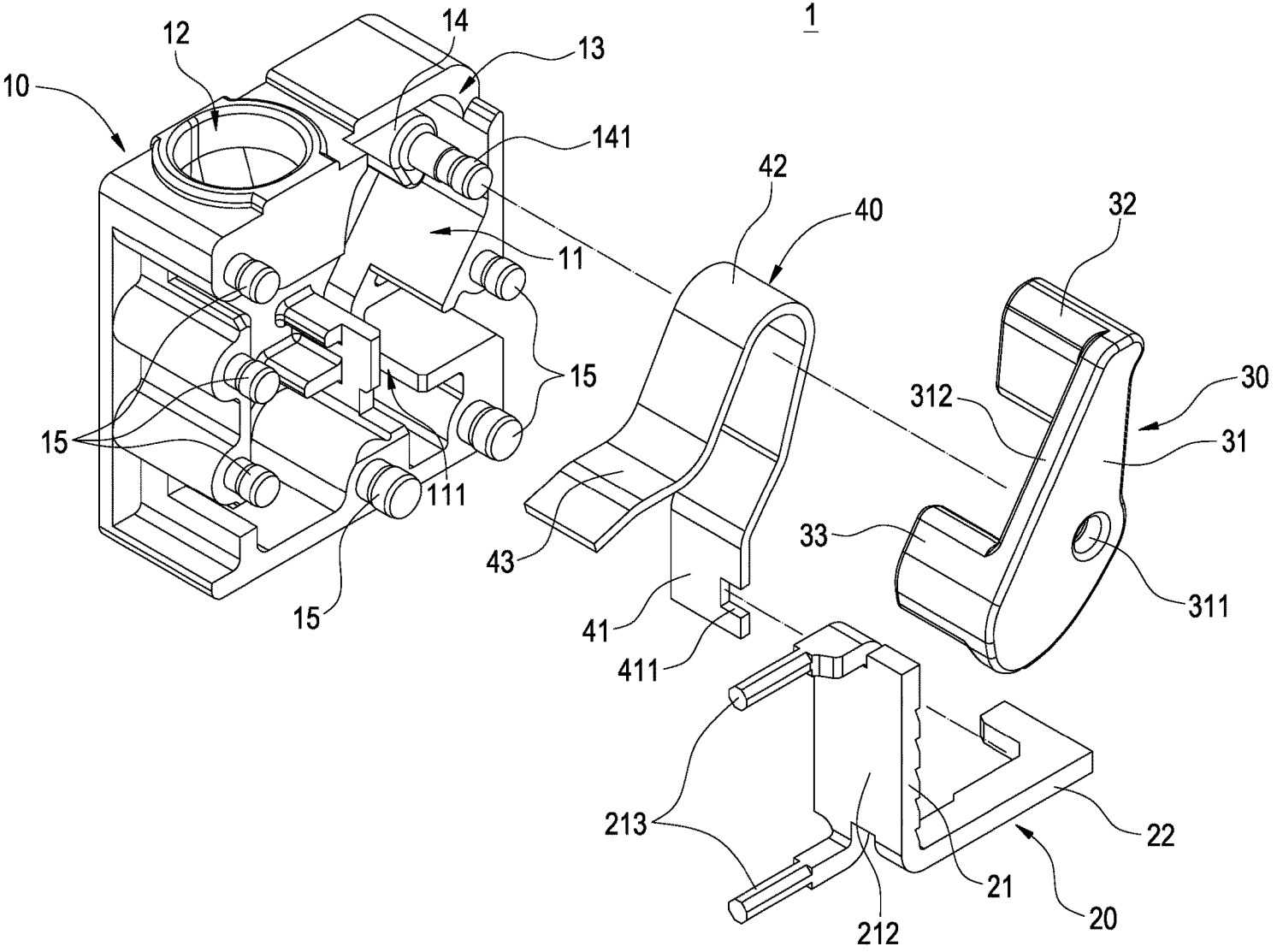
FIG. 1 is an exploded view of the terminal block structure.
Figure 2:
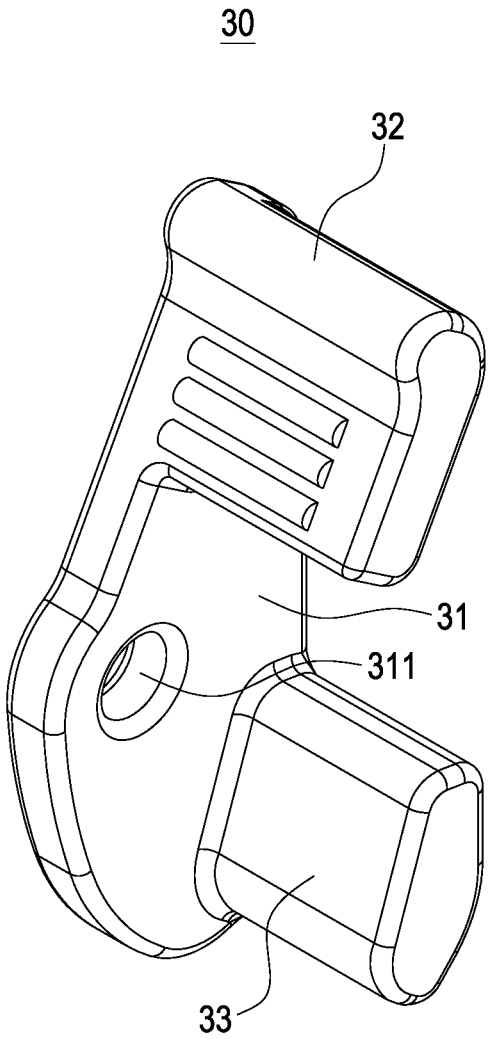
FIG. 2 is a perspective view of the toggle member.
Figure 3:
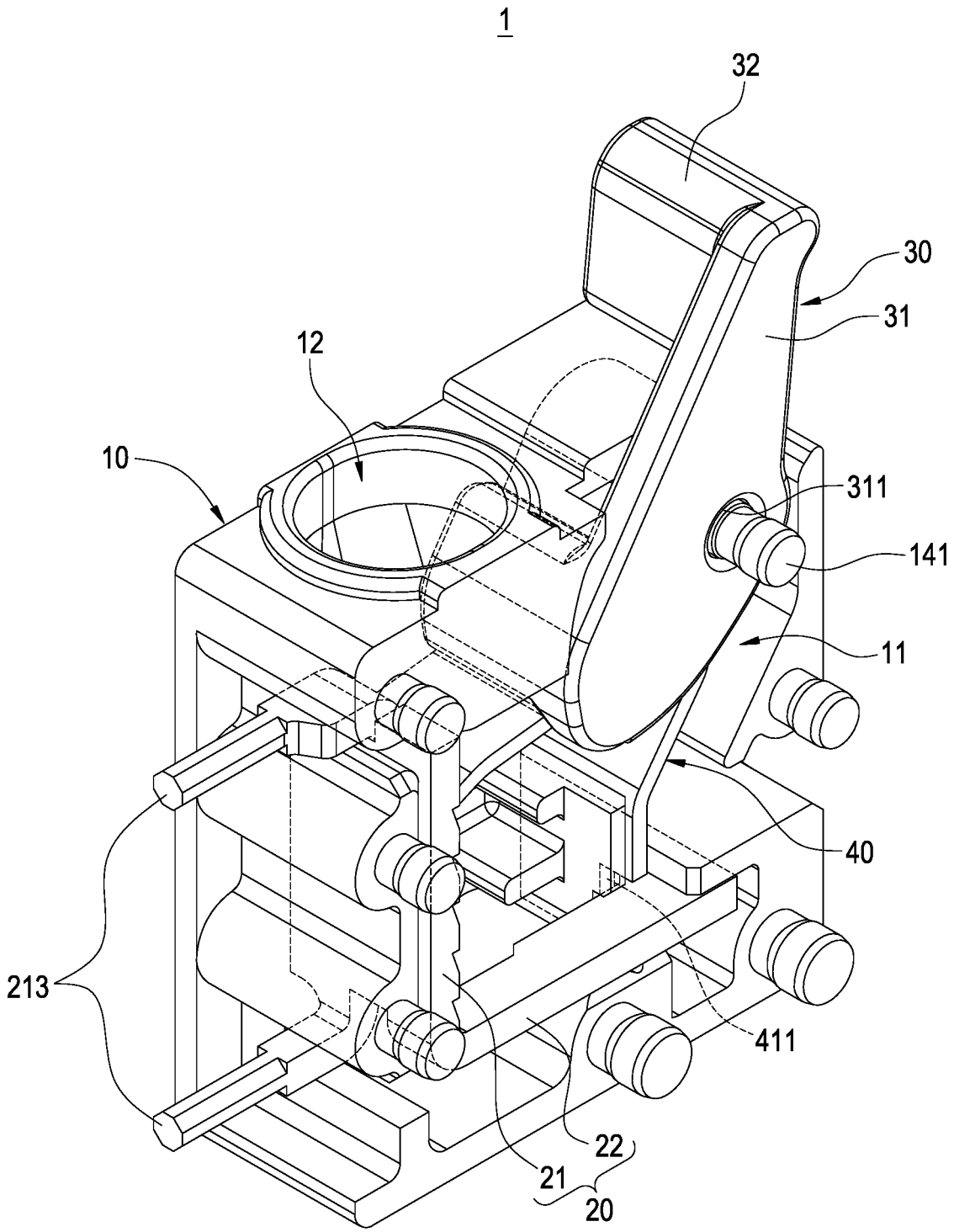
FIG. 3 is an assembled view of the terminal block structure.

The technical contents of this disclosure will become apparent with the detailed description of embodiments accompanied with the illustration of related drawings as follows. It is intended that the embodiments and drawings disclosed herein are to be considered illustrative rather than restrictive.

The disclosure provides a terminal block structure 1 with easy wire insertion for a wire A to be inserted therein. The wire A has a core line A1. Please refer to FIGS. 1-4. The terminal block structure 1 includes an insulative base 10, a conductive terminal 20, a toggle member 30 and an elastic clamping piece 40.

The insulative base 10 is made of plastic or other insulative materials and has a chamber 11 inside. A top of the insulative base 10 is formed with a wire hole 12 and an opened trough 13. The wire hole 12 and the opened trough 13 communicate with the chamber 11. The wire hole 12 and the opened trough 13 are adjacent to each other and located on the same side of the insulative base 10. An engaging trough 111 is formed in the chamber 11 of the insulative base 10. A rod 14 is protruded and disposed in the chamber 11 and adjacent to the opened trough 13.

The conductive terminal 20 is made of material with preferable conductivity, such as copper or an alloy thereof. The conductive terminal 20 is fixed in the chamber 11 and arranged corresponding to a lower position of the wire hole 12. The conductive terminal 20 includes a first conductive piece 21 and a second conductive piece 22 perpendicularly bent from the first conductive piece 21. The first conductive piece 21 has a contact surface 211 parallel to the inserting direction of the wire A and an attaching surface 212 opposite to the contact surface 211. When the wire A is inserted, the core line A1 contacts with the contact surface 211. The attaching surface 212 contacts with an inner wall of the chamber 11. Two ends of the first conductive piece 21 are respectively extended with a connecting pin 213. Each of the connecting pins 213 projects to outside of the insulative base 10 from the chamber 11.

The toggle member 30 is made of plastic or other insulative materials and includes a main body 31, a stem 32 and a pressing portion 33. The stem 32 and the pressing portion 33 are spaced apart and extended from the main body 31 and located on the same side of the main body 31. In this embodiment, the stem 32, the pressing portion 33 and the main body 31 are formed in a single piece, but not limited to this, for example, the stem 32 and the pressing portion 33 may also be fixed on the main body 31 by snapping or fastening. The main body 31 has a pivoting portion 311 pivotally connected to the rod 14 of the insulative base 10. The pivoting portion 311 and the pressing portion 33 are arranged separately. In some embodiments, the pivoting portion 311 is arranged between the stem 32 and the pressing portion 33. The stem 32 projects to outside of the insulative base 10 from the opened trough 13 and is movable on a lateral side of the wire hole 12. Triggering the stem 32 may make the toggle member 30 rotate and swing about the pivoting portion 311 relative to the insulative base 10. In this embodiment, the rod 14 is further extended with a pivot 141 and the pivoting portion 311 is a shaft hole adapted to sheathe the pivot 141, but not limited to this, for example, the rod 14 may also be formed with a pivot hole and the pivoting portion 311 is a pivot.

The elastic clamping piece 40 is made of material with preferable conductivity, such as copper or an alloy thereof. The elastic clamping piece 40 is disposed in the chamber 11 and includes a fixing section 41, a moving section 43 and a connecting section 42 connected between the fixing section 41 and the moving section 43. The fixing section 41 is disposed in the engaging trough 111. The connecting section 42 is adapted to sheathe the rod 14 and restricted between the rod 14 and an inner wall of the chamber 11 so as to fix the elastic clamping piece 40 in the insulative base 10. Part of the moving section 43 abuts against a periphery of the pressing portion 33. The moving section 43 extends to a position below the wire hole 12 to abut against the first conductive piece 21. The moving section 43 is pressed by the pressing portion 33 to operably open or close the wire hole 12. Also, the fixing section 41 is formed with a notch 411. The notch 411 may be snapped by the second conductive piece 22 to further fix the conductive terminal 20.

Figure 5:
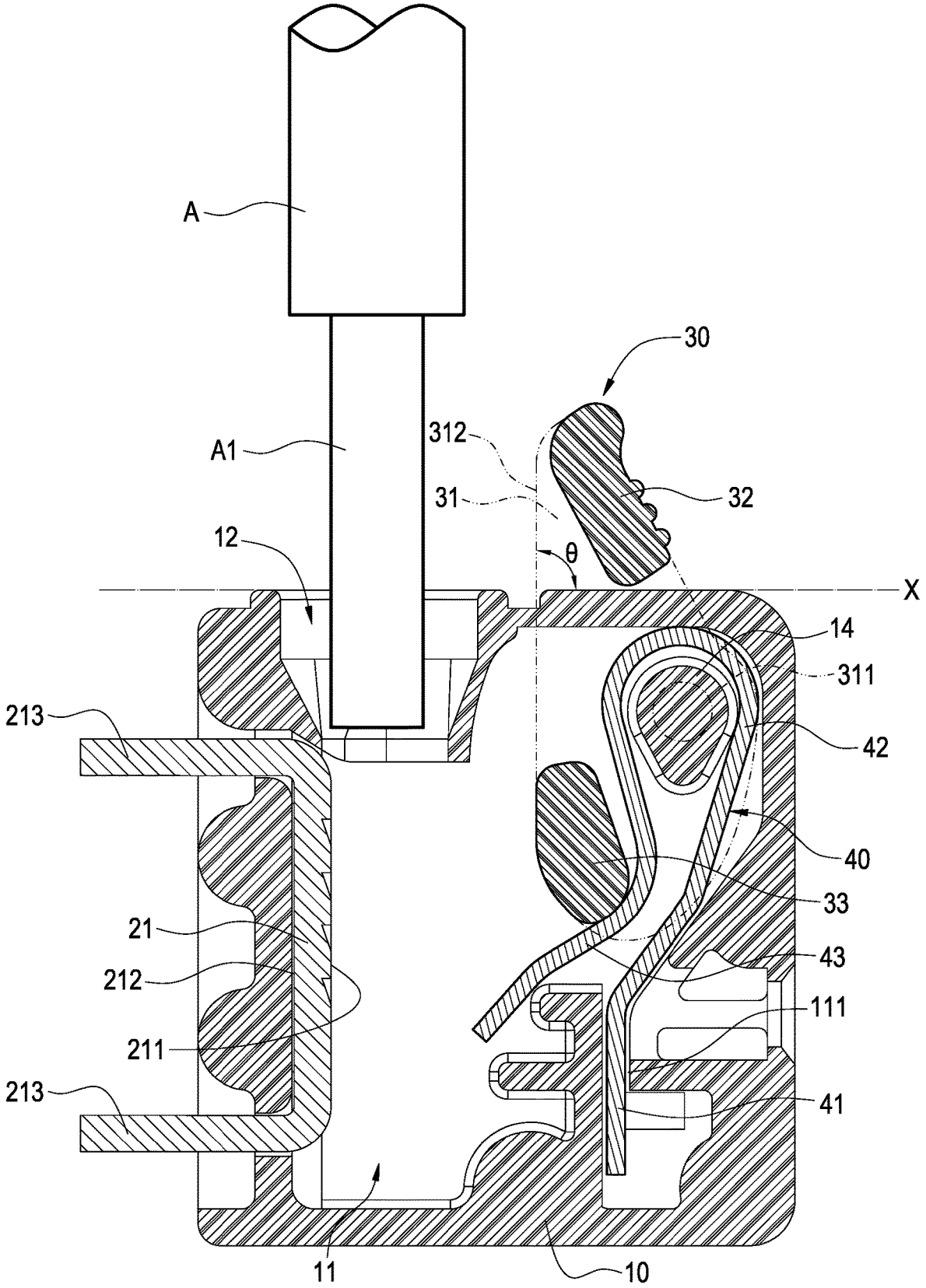
FIG. 5 is a schematic view of the terminal block structure in use.
Figure 6:
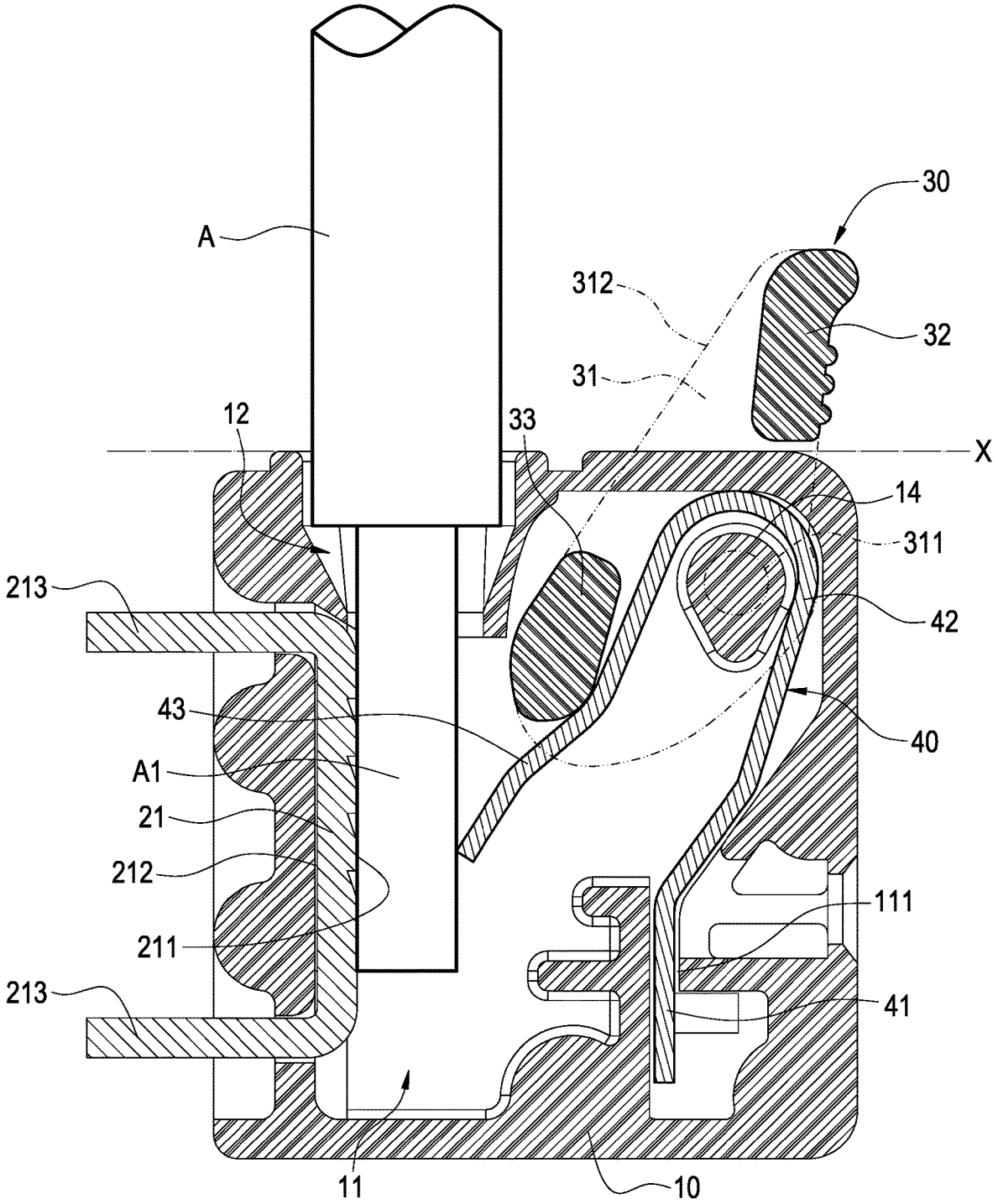
FIG. 6 is another schematic view of the terminal block structure in use.

Please refer to FIGS. 5 and 6, which are schematic views of the terminal block structure 1 in use. When the wire A is inserted, the stem 32 is triggered toward the wire hole 12 to make the pressing portion 33 press the moving section 43 of the elastic clamping piece 40 downward to open the wire hole 12, so that the wire A may be inserted into the wire hole 12 and a side of the core line A1 may contact with the contact surface 211 of the first conductive piece 21. Next, the stem 32 is triggered toward the direction away from the wire hole 12 to make the moving section 43 of the elastic clamping piece 40 disengage from the pressing of the pressing portion 43, and the moving section 43 and the first conductive piece 21 jointly clamp the core line A1 by the restorative elasticity of the moving section 43. The acting range of the stem 32 is located above the insulative base 10 only, so the operation space required by the stem 32 during operating process may be effectively saved. In addition, the pivoting portion 311 is disposed between the stem 32 and the pressing portion 33, so the pressing portion 33 may be opened or closed to maximum extent so as to ease the insertion of a wire.

Figure 4:
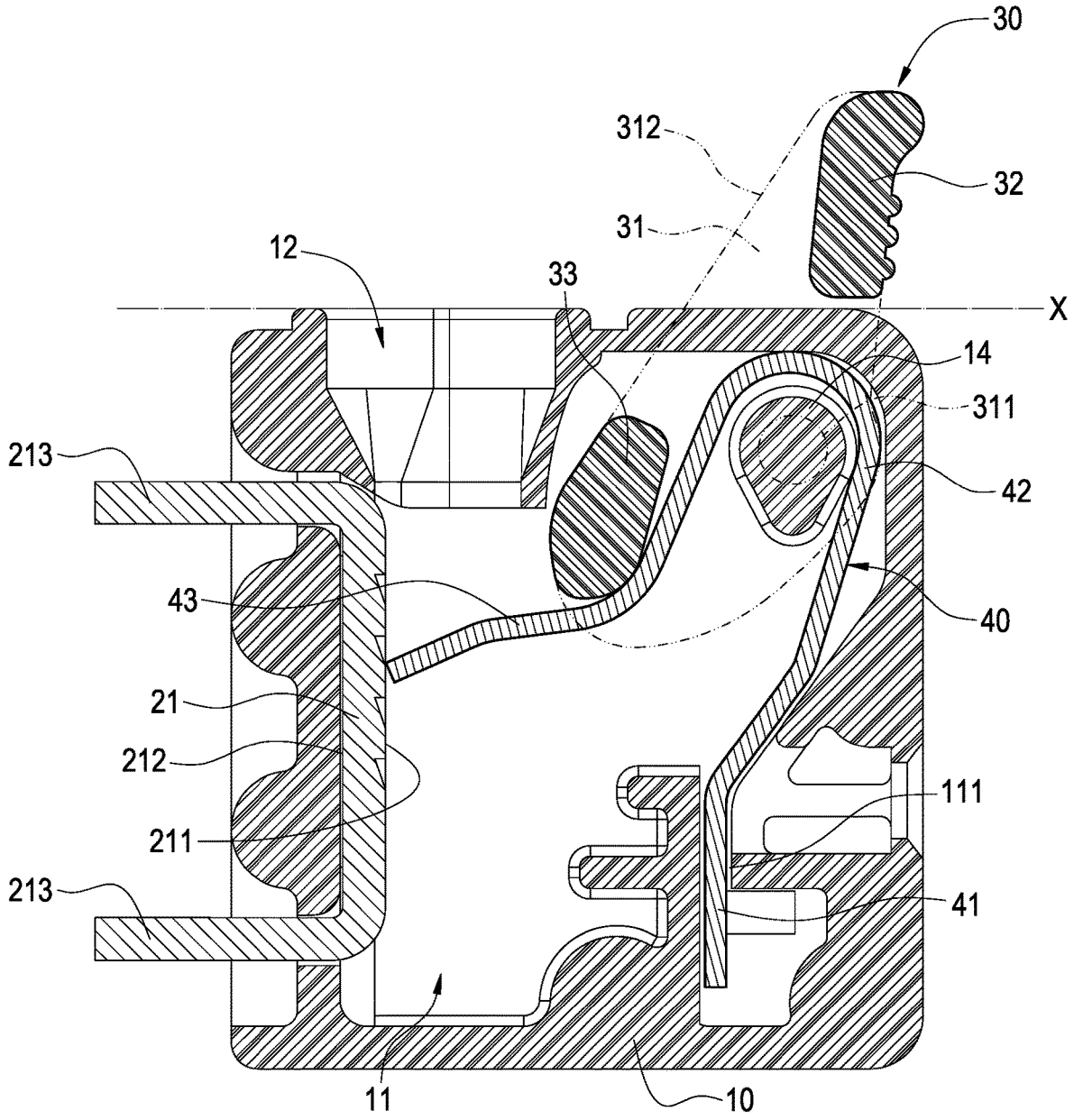
FIG. 4 is a cross-sectional view of the terminal block structure.

Moreover, please refer to FIG. 4, the top of the insulative base 10 possesses a baseline x. While the toggle member 30 is not being used, the elastic clamping piece 40 pushes the pressing portion 33 upward to near the top of the chamber 11 by its own elasticity so as to make the stem 32 be operated and moved above the baseline x. In some embodiments, a side of the stem 32 is coplanar with a lateral side of the insulative base 10 to obtain maximum usable space on the lateral side of the insulative base 10 without causing interference between the lateral side of the insulative base 10 and the stem 32.

Please refer to FIG. 5 again. The main body 31 of the toggle member 30 has a long side 312, and a working angle θ is formed between the long side 312 and the baseline x. When the toggle member 30 is triggered, the main body 31 in the chamber 11 may be moved to near the inner wall of the chamber 11 so as to make the long side 312 parallel to the inserting direction of the wire A. Also, the long side 312 is perpendicular to the baseline x, i.e., the working angle θ is about 90°.

According to FIGS. 4 and 5, the rotation range of the toggle member 30 makes the working angle θ be between about 90° and about 120°. In the terminal block structure 1 of the disclosure, the stem 32 is operated and moved above the baseline, and the working angle θ is between about 90° and about 120°, thereby the saving of operating space is guaranteed and the opening and closing space of the elastic clamping piece 40 is increased.

Figure 7:
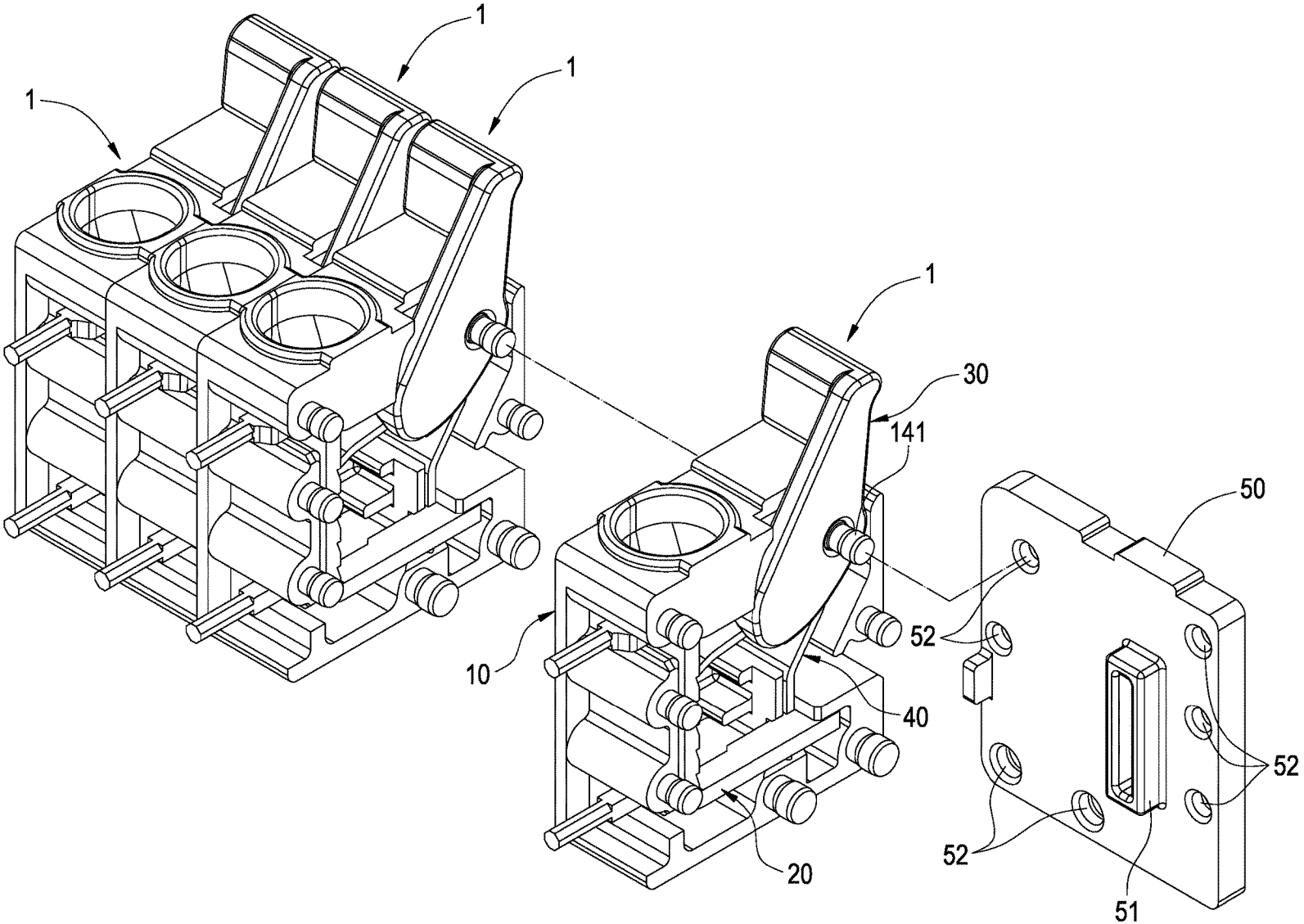
FIG. 7 is an exploded view of the multiple terminal block structures.
Figure 8:
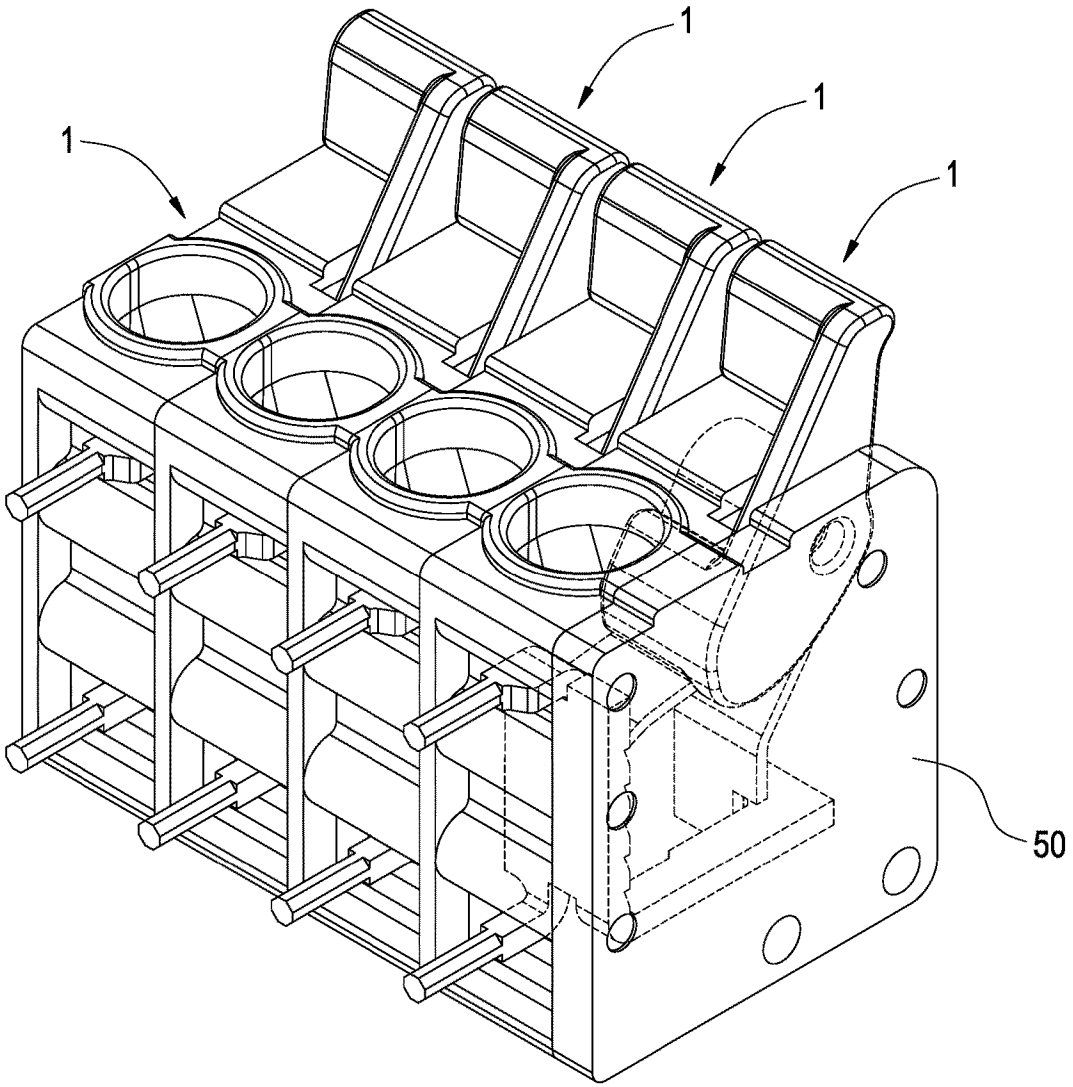
FIG. 8 is an assembled view of the multiple terminal block structures.

Please refer to FIGS. 7 and 8. The terminal block structure 1 further includes a cover plate 50 covering an edge of the insulative base 10 correspondingly. The insulative base 10 is further provided with multiple fixing bars 15. The cover plate 50 is provided with an engaging block 51 and multiple through holes 52. The engaging block 51 is engaged between the conductive terminal 20 and the top of the chamber 11. Each of the through holes 52 is adapted to sheathe the fixing bars 15 to fasten the cover plate 50 on the insulative base 10. In addition, the terminal block structure 1 may be connected with another terminal block structure 1 or multiple terminal block structures 1 to configure a terminal block assembly structure. Thus, by the compact overall structure, more terminal block structures may be accommodated in the same volume range to effectively reduce the installation and use costs.

While this disclosure has been described by means of specific embodiments, numerous modifications and variations could be made thereto by those skilled in the art without departing from the scope and spirit of this disclosure set forth in the claims.

What is claimed is:

1. A terminal block structure comprising:

an insulative base, comprising a chamber, a wire hole and an opened trough, wherein a top side of the insulative base forms a baseline substantially perpendicular to a setting direction of the wire hole, and the wire hole and the opened trough communicate with the chamber and are located on the top side of the insulative base;

a conductive terminal, fixed in the chamber, and arranged corresponding to the wire hole, wherein the conductive terminal has a contact surface;

a toggle member, comprising a main body, a stem and a pressing portion, wherein the stem and the pressing portion are spaced apart and extended from the main body; the main body comprising a pivoting portion pivotally connected to the insulative base, the pivoting portion arranged between the stem and the pressing portion, and the stem projecting to outside of the insulative base from the opened trough and being operated and movable on the top side of the insulative base and above the baseline only; and an elastic clamping piece, disposed in the chamber and comprising a moving section, wherein the moving section extends from a position below the opened trough to a position below the wire hole to abut against the contact surface, and the moving section being pressed by the pressing portion to operably open or close the wire hole.

2. The terminal block structure of claim 1, wherein the stem, the pressing portion and the main body are formed in a single piece, and the stem and the pressing portion are located on a same side of the main body.

3. The terminal block structure of claim 1, wherein the pressing portion and the pivoting portion are separately arranged.

4. The terminal block structure of claim 1, wherein the main body has a long side, and a working angle is defined between the long side and the baseline, and the working angle is between about 90° and about 120°.

5. The terminal block structure of claim 1, wherein an engaging trough is disposed in the chamber, and a rod is disposed in the chamber and adjacent to the opened trough.

6. The terminal block structure of claim 5, wherein the rod further comprises a pivot extended thereon, the pivoting portion comprises a shaft hole disposed on the main body, and the shaft hole is adapted to sheathe the pivot.

7. The terminal block structure of claim 5, wherein the elastic clamping piece comprises a fixing section, the moving section and a connecting section connected between the fixing section and the moving section, the fixing section is disposed in the engaging trough, the connecting section is adapted to sheathe the rod and restricted between the rod and an inner wall of the chamber, and the moving section abuts against the pressing portion and is extended to a position below the wire hole to contact with the conductive terminal.

8. The terminal block structure of claim 1, wherein the conductive terminal comprises a first conductive piece and a second conductive piece perpendicularly bent from the first conductive piece, two ends of the first conductive piece are respectively extended with a connecting pin, and each of the connecting pins projects to outside of the insulative base from the chamber.

9. The terminal block structure of claim 1, further comprising: a cover plate, covering a side of the insulative base correspondingly, wherein the insulative base further comprises multiple fixing bars, the cover plate comprises an engaging block and multiple through holes, the engaging block is engaged between the conductive terminal and the chamber, and each of the through holes is adapted to sheathe each of the fixing bars respectively.

* * * * *